United States Patent [19]

Benasutti

[11] 4,106,842

[45] Aug. 15, 1978

[54] ELECTRICAL CONTACT AND CONNECTOR

[75] Inventor: John Eugene Benasutti, Oil City, Pa.

[73] Assignee: GTE Sylvania Incorporated, Stamford, Conn.

[21] Appl. No.: 725,728

[22] Filed: Sep. 23, 1976

[51] Int. Cl.[2] ..... H01R 9/16

[52] U.S. Cl. ..... 339/221 R; 339/278 C

[58] Field of Search ..... 339/95 R, 220 R, 221 R, 339/221 L, 221 M, 275 C, 278 C; 85/21, 23

[56] References Cited

U.S. PATENT DOCUMENTS

| | | | |
|---|---|---|---|
| 2,099,555 | 11/1937 | Benander | 339/221 R |
| 2,576,528 | 11/1951 | Matthysse | 339/278 C |
| 3,671,917 | 6/1972 | Ammon | 339/221 M |
| 3,740,699 | 6/1973 | Johnson | 339/221 M |
| 3,818,415 | 6/1974 | Evans | 339/278 C |
| 3,977,075 | 8/1976 | Lynch | 339/176 MP |

*Primary Examiner*—Roy Lake
*Assistant Examiner*—E. F. Desmond
*Attorney, Agent, or Firm*—Robert E. Walter; John C. Fox

[57] ABSTRACT

An electrical contact having a contacting portion and a body portion adjoining said contacting portion. Positioned on a preselected area of the body portion are a plurality of irregular-shaped particles. An ideal use for the contact is within an electrical connector, said connector also disclosed.

11 Claims, 4 Drawing Figures

ELECTRICAL CONTACT AND CONNECTOR

BACKGROUND OF THE INVENTION

This invention relates to electrical contacts and to connectors which utilize electrical contacts.

Several means are employed in the electrical connector art for retaining an electrical contact within a connector housing. Perhaps the best known method is the utilization of a series of retaining "bumps" or protuberances on the contact's retention portion, the function of such members being to frictionally engage the internal walls of the connector's housing. Examples of this form of retention are shown in U.S. Pat. Nos. 3,670,294, 3,740,699 and 3,862,792. Still another method involves twisting the contact's retention portion within the corresponding opening of the housing.

The present invention concerns a unique means for providing positive contact retention. As will be described, the invention also defines a means whereby contact retaining forces are significantly increased in many of the known prior art methods of retention, e.g. those employing protuberance members and/or twisting.

OBJECTS AND SUMMARY OF THE INVENTION

It is therefore an object of the present invention to provide an electrical contact and connector which each employ a new means of contact retention.

It is another object of the invention to improve the existing contact and connector art by providing a means whereby many known methods of contact retention are significantly enhanced.

In accordance with one embodiment of the invention, there is provided an electrical contact which comprises a contacting portion and a body portion adjoining said contacting portion. Positioned on a preselected area of the contact's body portion are a plurality of irregular-shaped particles.

According to another embodiment of the invention, there is provided an electrical connector which comprises a housing having at least one opening therein and at least one electrical contact, said contact including a contacting portion and a body portion. Positioned within the connector in contact with and between the surface of an area on the body portion and the internal walls of the housing's opening are a plurality of irregular-shaped particles.

DETAILED DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
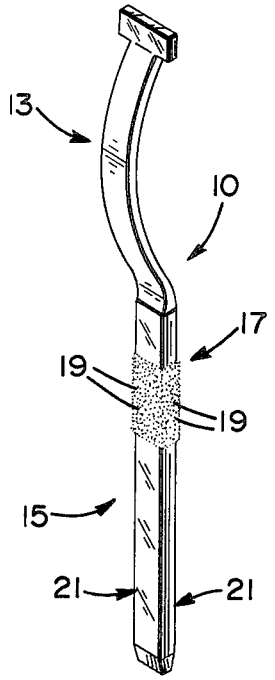
FIG. 1 is an isometric view of an electrical contact in accordance with one embodiment of the invention.

With particular reference to FIG. 1, there is shown an electrical contact 10 in accordance with a preferred embodiment of the present invention. Contact 10 comprises a contacting portion 13 and a body portion 15 adjoining portion 13. Positioned on a selected area 17 of body portion 15 are a plurality of irregular-shaped particles 19. As will be understood, the function of particles 19 is to provide a means of retention for contact 10 within a suitable housing. It will also be understood that utilization of particles 19 will substantially increase the retention forces for electrical contacts which employ various retention members, bumps, etc. Examples of these protruding retention features are clearly shown in the aforementioned U.S. Pat. Nos. 3,670,294, 3,740,699 and 3,862,792.

The material for contact 10 is preferably phosphor-bronze, beryllium-copper, nickel-silver, or any of the well known metallic alloys used for electrical contacts. Typically, the contact is produced from a 0.025 inch substantially square wire of these materials. In the embodiment shown in FIG. 1, body portion 15 retains this substantially square cross-sectional configuration while contacting portion 13 has been subjected to added manufacturing processes such as stamping, coining, etc.

It is preferred that the particles 19 be of a metallic material although non-metallic materials such as plastic can be successfully used. The preferred material for particles 19 is a copper alloy, said material defined as any alloy constituting at least 50 percent by weight copper.

When using a 0.025 inch square body portion 13 for contact 10, it is preferred that the average maximum width of the cross-sectional area of each irregularly-shaped particle 19 be within the range of about 0.002 to about 0.010 inches. It is additionally preferred to utilize approximately 800 particles for a preselected area of about 0.02 in.$^2$ Cross-sectional configurations other than square are permissible for body portion 15, including rectangular and cylindrical. It is still desired, however, that the number of particles utilized per square inch of preselected area by within the limits defined above.

Preselected area 17 preferably comprises a substantially continuous band about body portion 15, this holding true regardless of the cross-sectional configuration for portion 15. This is not meant to limit the present invention, however, as it is possible to employ particles 19 on a single area 17 located on a single corresponding side 21. It is also possible to employ areas 17 which are positioned in staggered relationship about body 15. It is further possible to employ at least two spacedly positioned areas 17 on a single side 21. It is understood, therefore, that several possible positioning combinations exist for area 17 and the embodiment shown in FIG. 1 is thus not meant to limit the broad aspects of the invention.

The preferred means for positioning particles 19 on body portion 15 is electrostatic deposition. One manner of accomplishing this is to place at least one contact 10 and a corresponding quantity of particles 19 within a container. The container is simply vibrated for an established time and adherence of the particles is attained. Other methods of deposition include use of suitable glues, cements, epoxies, etc. which may be applied to area 17. Particles 19 are next applied thereto while these sealants remain in a wet (undried) state. It is further possible to form a premix of these materials with the desired quantity of particles and thereafter apply the premix to the desired locations.

Figure 2:
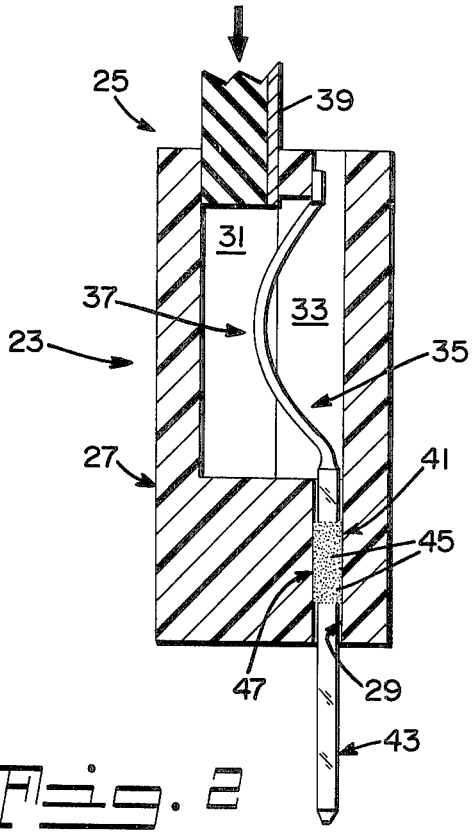
FIG. 2 is a side elevational view, partly in section, of an electrical connector in accordance with another embodiment of the invention.

In FIG. 2 there is shown an electrical connector 23 in accordance with a preferred embodiment of the invention. Although the illustrated usage for connector 23 is to receive and electrically engage a printed circuit board 25, the present invention should not be limited thereto. The invention as defined applies to all forms of electrical connectors which in turn employ electrical contacts such as shown in FIG. 1.

Connctor 23 comprises a housing 27 which includes at least one opening 29 therein. In the event that connector 23 is used for engaging printed circuit boards, housing 27 will further include a second opening 31 for receiving board 25 in addition to a recess 33 for having the contacting portion of the respective contact located therein.

As stated, connector 23 includes at least one contact 35 therein. Contact 35, substantially similar to contact 10 in FIG. 1, comprises a contacting portion 37 for effecting contact with a conductive portion 39 of board 25, and a body portion 41. Body 41 is shown as being adjoined to contacting portion 37. A portion of body 41 is adapted for being positioned within opening 29 of housing 27. In the case of printed circuit board connectors, contact 35 will usually further include a tail portion 43 which extends from housing 27 and is adapted for having an external electrically conductive means (not shown) joined thereto.

Positive retention of contact 35 within connector 23 is provided by utilization of a plurality of irregular-shaped particles 45 located on a preselected area 47 of body 41.

The preferred materials for contact 35, including particles 45, are the same for those defined for contact 13 in FIG. 1. This also holds true for the cross-sectional configurations and sizes thereof in addition to the respective size of the particles. The preferred material for housing 27 is electrically insulative and includes the several known materials typically utilized in electrical connectors, e.g. phenolics, nylons, etc.

Figure 3:
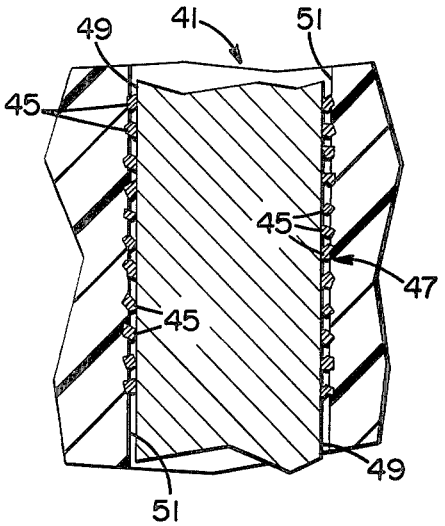
FIG. 3 is an enlarged elevational view of the retention area of the connector shown in FIG. 2.

As illustrated in the enlarged view shown in FIG. 3, each of the particles 45 are positioned between and in contact with the surface 49 of the respective preselected area 47 of body portion 41 and the corresponding internal walls 51 of opening 29 (FIG. 2). When utilizing a housing material as defined above and a particle material of a copper alloy, penetration of internal walls 51 will result due to the substantially greater hardness of the particles. This penetration wil result in all embodiments wherein metallic particles 45 are used in conjunction with housings of plastic material. In situations wherein the particles and body portion are of the same metallic material, major penetration of the body surface will not occur. Because most electrical contacts contain asperities within their external surfaces, some minor penetration therein may occur by portions of the irregular-shaped particles. This dual penetration (housing wall and body surface) will further increase the retention of contact 35. To further enhance retention, the internal walls 51 may be tapered inwardly in the direction of insertion to cause restriction of the particles to a smaller space during assembly.

EXAMPLE

A phosphor bronze cylindrical pin having an approximate diameter of 0.026 inches and a 50 millionths uniformly thick gold layer thereon was positioned within a glass-filled nylon housing. The accommodating cylindrical opening of the housing had a internal diameter slightly larger than 0.026 inches to provide a relatively snug fit between pin and housing. Excluding any particles, a force of approximately 5 lbs. was required to remove the pin from the provided opening. With a quantity of irregular abrasive particles positioned on a preselected area of the contact to mate with the internal wall of housing's opening, the force required to remove the positioned pin was about 7 lbs., representing an increase of 40 percent.

The above increases in retention forces also hold true for known electrical contacts which employ retention features such as protuberances, bumps, etc. Placement of the particles on these contacts is accomplished in much the same manner as described for contact 13 and 35 in FIGS. 1 and 2, respectively. The preselected areas designated to have the particles located thereon will thus include the above protuberance features.

Positioning of the particle material 45 within connector 23 may be accomplished in one of two ways. Contact 35 may have particles 45 positioned thereon in a manner similar to the positioning of particles 19 on contact 13 (FIG. 1) and the contact then inserted within opening 29 of the connector's housing. It is also possible to locate particles 41 within opening 29 prior to insertion of contact 35, said contact not having particles 41 thereon. This method of particle location may simply involve positioning housing 27 and particles 45 within a suitable container and thereafter vibrating or shaking the container to accomplish the desired electrostatic deposition of particles to the internal walls 51 of the housing. Contact 35 is then inserted into the desired location. Removal of excess particles which may have attached to the remaining areas of contact 35 and housing 27 may easily be accomplished by ultrasonic cleaning.

Figure 4:
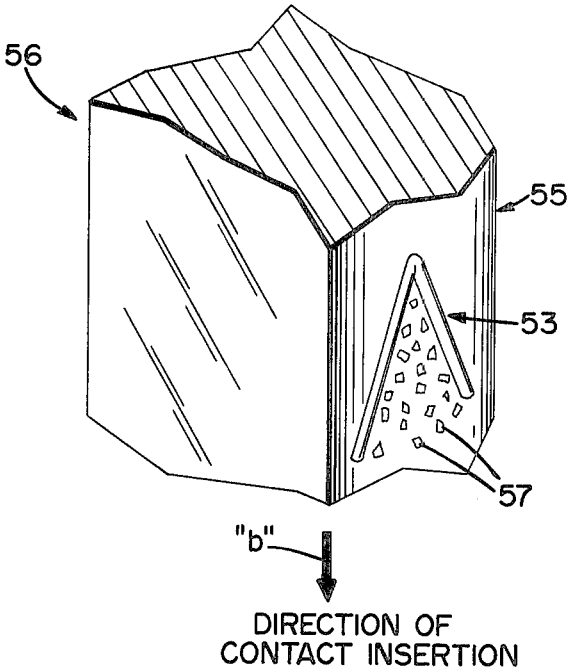
FIG. 4 represents a preferred embodiment for a rib portion for the contact of the invention.

In FIG. 4, there is shown in elevated rib portion 53 which is located on the body portion 55 of an electrical contact 56 such as those shown in FIGS. 1 and 2. The area wherein rib 53 is located thus represents the preselected area designated to have a plurality of particles 57 thereon. In the preferred embodiment of the invention, rib portion 53 is in the shape of a "V" having the open portion thereof located in a direction concurrent with the direction of contact insertion within a connector housing (not shown). The described direction of insertion is represented by arrow "*b*". In the broader aspects of the invention, rib portion 53 may assume other configurations such as an inverted "W", a plurality of in-line V-shaped members, etc. As is understood, the function of rib portion 53 is to funnel the particles 57 upwardly within the peak of the "V" to thereby increase the concentration of particles in this region. This concentrated mass of particles will thus serve as the retention means for contact 56.

Thus there had been shown and described an electrical contact which employs a plurality of particles to serve as the retention means for the contact. There has also been described and shown an electrical connector which utilizes a contact and the aforementioned particles. There has further been described a means for increasing the retention forces for electrical contacts which employ known retention features.

While there has been shown and described what are at present considered the preferred embodiments of the invention, it will be obvious to those skilled in the art that various changes and modifications may be made therein without departing from the scope of the invention as defined by the appended claims.

What is claimed is:

1. An electrical connector comprising a housing having at least one opening therein, an electrical contact including a contact portion and a body portion adjoining said contacting portion, the aforesaid housing openig defined by a wall, a portion of said wall carrying a plurality of irregular-shaped particles whereby when the contact body portion is inserted in said opening the irregular-shaped particles will engage the contact body and cut thereinto for retention of said contact in said housing.

2. In an electrical connector comprising a housing having at least one opening therein, and an electrical contact adapted for assembly within the opening in said housing, said contact comprising:

a contact portion;

a body portion adjoining said contacting portion, said body portion having a preselected area defining a portion of the body; and a plurality of irregular-shaped particles affixed to the preselected area of the body whereby when the body portion is inserted into the housing opening the irregular-shaped particles will engage the wall of said opening and cut thereinto for retention of said contact in said housing.

3. The connector according to claim 2 wherein said irregular-shaped particles are comprised of a metallic material.

4. The connector according to claim 3 wherein said metallic material is a copper alloy.

5. The connector according to claim 2 wherein said body portion of said contact comprises a substantially square cross-sectional configuration.

6. The connector according to claim 5 wherein each of the sides of said substantially square cross-sectional configuration of said contact is about 0.025 inches in length.

7. The connector according to claim 6 wherein the average maximum width of the cross-sectional area of each of said irregular-shaped particles is within the range of about 0.002 to about 0.010 inches.

8. The connector according to claim 2 wherein said irregular-shaped particles are positioned on said preselected area of said body portion of said contact by electrostatic deposition.

9. The connector according to claim 2 wherein said preselected area of said body portion of said contact includes at least one elevated rib portion.

10. The connector according to claim 9 wherein said elevated rib portion is of a substantially V-shaped configuration.

11. The connector according to claim 10 wherein the open portion of said V-shaped configuration is located on said preselected area of said body portion in a direction concurrent with the direction of insertion of said body within said opening of said housing.

* * * * *